United States Patent [19]

Bach

[11] 4,424,258

[45] Jan. 3, 1984

[54] SELF-CRIMPING MULTI-COMPONENT POLYESTER FILAMENT WHEREIN THE COMPONENTS CONTAIN DIFFERING AMOUNTS OF POLYOLEFIN

[75] Inventor: Hartwig C. Bach, Pensacola, Fla.

[73] Assignee: Monsanto Company, St. Louis, Mo.

[21] Appl. No.: 460,708

[22] Filed: Jan. 24, 1983

Related U.S. Application Data

[63] Continuation-in-part of Ser. No. 320,827, Nov. 12, 1981, abandoned.

[51] Int. Cl.[3] ..... D01D 5/12; D01D 5/22

[52] U.S. Cl. ..... 428/370; 264/168; 264/171; 264/176 F; 264/210.8; 428/373; 428/374

[58] Field of Search ..... 428/370, 371, 373, 374; 264/176 F, 210.8, 168, 171

[56] References Cited

U.S. PATENT DOCUMENTS

| | | | |
|---|---|---|---|
| 3,039,524 | 6/1962 | Belak et al. | 428/374 |
| 3,182,106 | 5/1965 | Fujita et al. | 428/374 |
| 3,408,277 | 10/1968 | Martin et al. | 264/168 |
| 3,531,368 | 9/1976 | Okamoto et al. . | |
| 3,536,802 | 10/1970 | Uraya et al. | 264/171 |
| 3,582,418 | 6/1971 | Schuur | 156/83 |
| 3,725,192 | 4/1973 | Ando et al. | 264/177 F |
| 3,780,149 | 12/1973 | Keuchel et al. | 264/168 |
| 3,901,989 | 8/1975 | Hokonoki et al. | 428/370 |
| 3,968,307 | 7/1976 | Matsui et al. . | |
| 3,973,073 | 8/1976 | Barbe et al. | 428/370 |
| 4,293,614 | 10/1981 | Plischke et al. | 428/370 |
| 4,297,412 | 10/1981 | Orchard et al. | 428/370 |

*Primary Examiner*—James C. Cannon
*Attorney, Agent, or Firm*—John W. Whisler

[57] ABSTRACT

A self-crimping multi-component polyester filament is provided and a process for producing the filament. In its simplest form, the filament is composed of two components each of which comprises a polyester of the same chemical composition and one of which contains a minor amount of a polyolefin admixed with the polyester. The filament is formed by co-extruding the components to form a conjugate filament that is attenuated in the molten state, solidified and then collected. Attenuation of the filament in the molten state imparts self-crimping properties and molecular orientation to the filament.

25 Claims, No Drawings

SELF-CRIMPING MULTI-COMPONENT POLYESTER FILAMENT WHEREIN THE COMPONENTS CONTAIN DIFFERING AMOUNTS OF POLYOLEFIN

CROSS-REFERENCE TO RELATED APPLICATIONS

This application is a continuation in part of copending application Ser. No. 320,827, filed Nov. 12, 1981, now abandoned.

BACKGROUND OF THE INVENTION

A. Field of the Invention

This invention relates to a novel self-crimping, multi-component filament and to a process for producing the same. More specifically, the invention relates to a self-crimping bicomponent filament in which both components comprise a polyester of the same chemical structure and one or both of the components also contains a polyolefin admixed with the polyester. The components are conjugately melt spun to form the filament which is then attenuated while in the molten (or semi-molten) state. The attenuation of the molten filament imparts self-crimping properties and molecular orientation thereto. The term "self-crimping filament" as used herein means a filament which develops crimp when the tension (e.g. spinning or drawing tension) is released and the filament heated.

B. Description of the Prior Art

Processes are known in the art for preparing self-crimping filaments by conjugately spinning two different polyesters in a side-by-side arrangement to provide bicomponent filaments. In such processes, low orientation bicomponent filaments are conjugately spun and collected at relatively low speeds in a first operation. The filaments are thus drawn in a separate operation to impart crimp and high molecular orientation to the filaments. The polyesters may be different with respect to chemical structure and/or melt viscosity. Self-crimping filaments produced by such processes are disclosed in U.S. Pat. Nos. 3,408,277; 3,536,802 and 3,780,149.

It is an object of the present invention to provide a less complicated process for producing self-crimping polyester filaments.

SUMMARY OF THE INVENTION

In accordance with the present invention a melt spun, helically crimped, multi-component filament is provided wherein at least one component comprises a polyester containing a minor amount of a polyolefin or substituted polyolefin dispersed therein and the other component(s) comprise a polyester of the same chemical structure containing a lesser amount of the polyolefin or substituted polyolefin dispersed therein. Preferably, the filament is a bicomponent filament and only one of the components contains polyolefin or substituted polyolefin dispersed therein. The process by which the filament is formed comprises co-extruding the two fiber-forming components downwardly through a capillary or capillaries of a spinneret at a given linear speed (extrusion speed) to form a molten multi-component filament, cooling the molten filament in a quenching zone to form a solid filament, attenuating and accelerating the molten filament from its point of formation by withdrawing the solidified filament from the quenching zone at a speed (spinning speed) which is greater than the extrusion speed, wherein the extrusion speed, spinning speed, amount of polyolefin or substituted polyolefin in the components and the denier of the filament are correlated to provide an as-spun filament having a total bulk of at least 10%, when measured as hereinafter defined. The process is characterized in being a single operation; the separate drawing operation characteristice of the prior art processes is eliminated. Moreover, the same polyester is used for both components of the filament thereby eliminating adhesion problems and the cost of providing polymers of different chemical structure. Although it is not necessary, it is preferred for economical reasons that the polyester not only be of the same chemical structure but also be the same in all other respects such as molecular weight.

DETAILED DESCRIPTION OF THE PREFERRED EMBODIMENTS

While the filaments of the invention may be composed of more than two components, the two-component or bicomponent filament is preferred since it offers economical advantages over the other multi-component filaments; as the number of components increases, the process for producing the filaments becomes more and more complicated and less and less practical. Accordingly, the invention is described herein with reference to the bicomponent filament. The bicomponent filament of the invention comprises a polyester and a substituted or unsubstituted polyolefin. The polyester comprises the major ingredient of both components and the polyolefin is admixed with the polyester of at least one component. In order that helical crimp be imparted o the filaments during spinning, it is necessary that there be a higher concentration of polyolefin in one of the components than in the other component. Conveniently, this difference in concentration of the polyolefin is achieved simply by adding polyolefin to only one of the components.

Polyethylene terephthalate polyesters are of the greatest commercial interest and are those containing at least 85 mole percent, preferably at least 95 mole percent, of ethylene terephthalate units. The preferred polyester is a polyethylene terephthalate (PET), but copolyesters containing less than 15 mole percent of other copolymerizable components may also be used. Examples of other acid components that may be used in conjunction with terephthalic acid include dibasic acids such as phthalic acid, isophthalic acid, naphthalene-2,6-dicarboxylic acid, adipic acid, oxalic acid, sebacic acid or suberic acid. Examples of other alcohol components that may be used in conjunction with ethylene glycol are dihydric alcohols such as polymethylene glycols having 2 to 10 carbon atoms (trimethylene glycol and butylene glycol, for example) and cyclohexane dimethanol.

The polyester may contain a minor amount of a modifier such as 5-oxydimethyl isophthalate, 5-oxydimethyl hexahydroisophthalate, benzene-1,3,5-tricarboxylic acid, para-carbomethoxyphenyl diethyl phosphonate, 3,5-dicarboxy phenyl diethyl phosphate, pentaerythritol, glycol, phosphoric acid, triphenyl phosphate, tri-1-carbomethoxyphenyl phosphate, triphenyl arsenite, tricapryl boric acid, sorbitan, trimesic acid or diethylene glycol.

The polyester may also contain minor amounts of the usual additives such as delustrants, antistates, antioxidants, pigments, dyestuffs and fireproofing agents.

Polyolefins and substituted polyolefins that may be used in practicing the invention are normally incompatible, i.e., immiscible, with the polyester and are high molecular weight polymers consisting essentially of recurring units of the general formula:

$$-CH_2CRR'-$$

where R and R' are selected from atoms of radicals which are inert in the sense that they do not render the polyester incapable of forming fibers. Such atoms and radicals include hydrogen, methyl, ethyl, phenyl, cyano, $-COOCH_3$, and $-OCOCH_3$. The polyolefins are formed by polymerization of monomers (olefins and substituted olefins) of the general formula $CH_2{=}CRR'$. Polymers of this general description include polyethylene, polystyrene, polypropylene, polyisobutylene and copolymers thereof. The polyolefin-containing polyester component may be prepared by admixing (e.g., blending) appropriate amounts of the polyolefin and polyester. Generally, from about 0.5 to 10% by weight of the polyolefin admixed with the polyester will provide filaments having a total bulk of at least 10%. Lesser or greater percentages of the polyolefin may be used if desired. However, amounts of the polyolefin large enough to adversely effect the spinning and properties of the filaments should be avoided. The polyolefin may be admixed with the polyester by conventional techniques, for example, by blending of appropriate amounts of polyester and polyolefin flake either prior to extrusion or in the melt. If desired, a mixture of polyolefins may be employed.

The filaments of the present invention are produced by co-extruding the polyester component and the polyolefin-containing polyester component in a side-by-side (or asymmetric sheath-core) configuration in a conventional manner to form a bicomponent (or conjugate) filament. For example, two components may be combined and then extruded through a common spinneret capillary to form the filament, or each component may be extruded through a separate capillary in such a manner that the components converged above, at, or under the spinneret face to form the filament. While a filament having three or more components may be made by the process of this invention, a filament having two components is preferred. The ratio of the polyester components of the filament may be varied over a wide range. As a practical matter, the ratio of a two component system should be within the range of 2:1 to 1:2 with a ratio of 1:1 being preferred for simplicity reasons.

The extruded molten filament is quenched, that is, cooled to form a solid filament in a quenching zone. The filament is attenuated and accelerated form its point of formation by being withdrawn from the quenching zone at a given speed which is normally referred to as the "spinning speed". Most of the attenuation of the filament occurs while the filament is in the molten (or semi-molten) state. The filament may then be collected (e.g. wound onto a bobbin or piddled into a suitable container) or further processed, such as being cut into staple length fibers. The filament may be withdrawn from the quenching zone by means of a pneumatic aspirator, a pair of rolls (such as, a pair of nip rolls one of which is driven as a driven roll and its associated separator roll around which the filament makes several wraps to keep it from slipping on om slipping on the roll) or other suitable means.

In accordance with the present invention the spinning speed, the extrusion speed, amount of polyolefin or substituted polyolefin in the components and the denier of the filament are correlated to provide a total bulk of at least 10%. The extrusion speed is the linear speed at which the molten polyester is theoretically traveling through the spinneret capillary or capillaries and is calculated from the dimensions of the capillary, the extrusion rate and the polymer density. When more than one capillary is used to form the filament, the linear speeds are averaged and the average speed is used as the extrusion speed. The term "jet-stretch" (JS) as used herein represents the quotient obtained by dividing the spinning speed (SS) by the extrusion speed (ES).

In general, changing one or more of the processing variables while holding the others the same has the following effect on bulk:

(1) spinning speed—increasing the spinning speed increases the bulk;

(2) extrusion speed—increasing the extrusion speed reduces the bulk;

(3) denier—increasing the denier per filament (dpf) reduces the bulk.

In terms of jet-stretch, increasing the jet-stretch increases the bulk.

A filament produced by the process of this invention has a total bulk level of at least 10% and an elongation-to-break ($E_b$) below 120%, for example, between 65% to 100%.

Attenuation of the filament imparts self-crimping properties and molecular orientation to the filament. At high spinning speeds, e.g., >2750 meters per minute (mpm), the filament often crimps spontaneously when the spinning tension is released, for example, when the filament is unwound from the take-up bobbin. Further crimp develops when the filament is subjected to heat (e.g., heated at 120° C. while under no tension, that is, while relaxed). At lower spinning speeds (e.g., 1500 mpm), the filament is less likely to develop significant crimp until subjected to heat while relaxed.

MEASUREMENTS

Percent crimp, spontaneous crimp, thermally induced bulk, total bulk and thermal shrinkage are determined from the following measurements made on a sample (filament or bundle of filaments, i.e., yarn):

(1)

Determine the denier of the sample.

(2)

Calculate the number of revolutions on a denier reel that would be required to make a skein composed of a strand of filaments having a denier of 27060.

No. of Revolutions=27060/Denier (3)

Prepare a skein having a denier of 27060 from the sample.

(4)

a. Vertically hang the skein from a stationary hook by placing the strand of the skein over the hook.

b. With the skein hanging vertically from the hook, suspend a 50 g weight from the bottom end of the skein by hooking the weight over the strand (the skein now has the appearance of a single 54120 denier strand).

c. After the weight has been suspended for 0.5 minutes, determine the length (D) of the doubled skein.
d. Remove the weight.

(5)

Repeat (4) using a 4.54 kg (10 lb) weight instead of a 50 g weight. The length determined in this instance is length (B).

(6)

Place the skein, without a weight, in a forced draft oven at 180° C. for 5 minutes.

(7)

Remove the skein from the oven and let it cool for 1 minute.

(8)

Repeat (4). The length determined in this instance is length (E).

(9)

Repeat (5). The length determined in this instance is length (F).

$$\% \text{ original bulk} = (B-D)/B \times 100$$

and is the percentage difference in length of a skein of yarn in the crimped and extended state. Original bulk is measured without any heat treatment of the yarn and, therefore, indicates crimp spontaneously developed during spinning.

$$\% \text{ Total Bulk} = (B-E)/B \times 100$$

and is original bulk plus the crimp developed by heating a skein of the yarn for 5 minutes at 180 C.

$$\% \text{ Thermal Bulk} = (B-E)/D \times 100$$

Thermal bulk is that portion of the total bulk which is developed by heat and is not present in the original spun yarn.

$$\% \text{ Thermal Shrinkage} = (B-F)B \times 100$$

and is the percent difference in length of a skein of yarn in the extended state before and after heating.

$$\% \text{ Crimp} = (F-E)/F \times 100$$

and is the percent difference in length of a skein of yarn after having been heated in the extended and the crimped state.

The following examples are given to further illustrate the invention. Unless otherwise specified in the examples, blends are given in weight ratios, for example, a 95/5 blend is a blend consisting of 95 parts by weight of polyester and 5 parts per weight of polyolefin.

EXAMPLE 1

This example illustrates the spinning process of the invention and also shows the effect of spinning speed on bulk.

A high molecular weight polyethylene terephthalate (PET) and a 90/10 blend of the same PET with polystyrene were co-extruded in a side-by-side configuration and in a 1:1 ratio through a spinneret which allowed the polymer streams to converge before exiting from the spinneret capillary. The spinneret had 17 circularly spaced holes (capillaries) each having a diameter of 40-mil (1.27 mm). The extrusion temperature was 280 C. and the extrusion speed through the capillaries was 1.2 mpm. A convergence guide (metered finish pin) was located 6 feet (1.82 m) from the face of the spinneret. The yarn, after passing through ambient air to effect quenching (5 feet/1.5 m) was wound up at a speed (spinning speed) of 5000 ypm. Measurements (hereinbefore described) were made on the yarn except the heat treatment in this instance was only 3 minutes at 180° C. instead of 5 minutes. The yarn showed a Thermal Bulk of 76% and a Thermal Shrinkage of 60% and, therefore, a Net Crimp of 16%.

EXAMPLE 2

In this example, a bicomponent yarn was prepared under the same conditions used to prepare the yarn of Example 1, except in this instance, a 95/5 blend (PET/polystyrene) was spun conjugately against the same PET in a ratio of 3:2 (blend:PET). Measurements made on the resulting yarn showed the yarn to have a Thermal Bulk of 51% and a Thermal Shrinkage of 22.6% and, therefore, a Wet Crimp of 28.5%.

EXAMPLE 3

In this example, a bicomponent yarn was prepared as described in Example 1, except in this instance a 95/5 blend of PET with a 75/25 styrene/acrylonitrile copolymer was spun conjugately against the same PET, first, at a windup speed of 5000 ypm (4572 mpm) and, then at 6000 ypm (5486.4 mpm). At 5000 ypm a yarn with 55% Thermal Bulk, 29% Thermal Shrinkage and 26% Net Crimp was obtained. At 6000 ypm a yarn with 21.3% Thermal Bulk, 9% Thermal Shrinkage and 12.3% Net Crimp; tenacity and elongation-to-break were 2.5 grams per denier (gpd) and 29%, respectively.

EXAMPLE 4

In this example, a bicomponent yarn was prepared as in Example 3, except in this instance a windup (spinning) speed of 5500 ypm (5029.2 mpm). The resulting yarn had the following properties:

Tenacity (gpd): 2.3
Elongation-to-break (%): 31.2
Modulus (gpd): 23
Thermal Bulk (%): 55
Thermal Shrinkage (%): 26.7
Net Crimp (%): 27.3

EXAMPLE 5

In this example, using a laborator conjugate spinning machine with a 5 foot (1.5 meter) quench zone (no quench air), a 96/4 blend of PET with Vistanex® polymer (Vistanex® is a trademark of Enjay Chemical Co. for a polyisobutylene rubber) was spun conjugately against the same PET at 302° C. The yarn was wound up at 5000 ypm (4572 mpm) and showed fair Original Bulk.

I claim:

1. A process for producing a self-crimping, multicomponent filament, comprising, co-extruding at a given speed (extrusion speed) at least two molten fiber-forming components in a side-by-side or asymmetric sheathcore configuration to form a molten multicomponent filament, wherein one of the components comprises a polyester containing a minor amount of polyolefin dispersed therein and the other component(s) comprises (comprise) a polyester of the same chemical structure containing a lesser amount of polyolefin, cooling the molten filament in a quenching zone to form a solid filament, attenuating and accelerating the filament from its point of formation by withdrawing the solidified filament from the quenching zone at a speed (spinning speed) which is greater than the extrusion speed, wherein the extrusion speed, amount of polyolefin in the components, the spinning speed and denier of the filament are correlated to provide an as-spun filament having a total bulk of at least 10% and wherein said polyolefin consists essentially of recurring units of the formula —$CH_2CRR'$— where R and R′ are atoms or radicals which do not render said polyester incapable of forming fibers.

2. The process of claim 1 wherein the components comprise polyesters of substantially the same molecular weight.

3. The process of claim 2 wherein the filament is composed of two components.

4. The process of claim 3 wherein only one of the components contains said polyolefin.

5. The process of claim 4 wherein the ratio of the two components is within the range of 2:1 to 1:2.

6. The process of claim 5 wherein the ratio of the two polyesters is 1:1.

7. The process of claim 5 wherein the spinning speed is at least 1828 meters per minute.

8. The process of claim 5 wherein the polyester of each component is polyethylene terephthalate.

9. The process of claim 8 wherein the spinning speed is at least 4114 mpm.

10. The process of claim 8 wherein the components are co-extruded in a side-by-side configuration.

11. The process of claim 8 wherein the polyolefin and/or substituted polyolefin consists essentially of recurring units of the formula —$CH_2CRR'$— where R and R′ are selected from the group consisting of hydrogen, methyl, ethyl, phenyl, cyano and carboxyl.

12. The process of claim 8 wherein the polyolefin is polystyrene.

13. The process of claim 8 wherein the polyolefin is a copolymer of ethylene and propylene.

14. The process of claim 8 wherein the polyolefin is a copolymer of styrene.

15. A helically crimped, multi-component filament having the components arranged in a side-by-side or asymmetric sheat-core configuration, characterized in that: the filament has a total bulk of at least 10%; one component comprises a polyester containing dispersed therein a minor amount of at least one polyolefin consisting essentially of recurring units of the formula —$CH_2CRR'$— where R and R′ are atoms or radicals which do not render said polyester incapable of forming fibers; and the other component(s) comprises(comprise) a polyester of the same chemical structure containing a lesser amount of said polyolefin.

16. The filament of claim 15 wherein the filament is a bicomponent filament.

17. The filament of claim 16 wherein only one of the components contains said polyolefin.

18. The filament of claim 17 wherein both components comprise a polyester of substantially the same molecular weight.

19. The filament of claim 18 wherein the ratio of the two components is within the range of 2:1 to 1:2.

20. The filament of claim 19 wherein the ratio is 1:1.

21. The filament of claim 19 wherein the polyester is polyethylene terephthalate.

22. The filament of claim 21 wherein R and R′ are selected from hydrogen, methyl, ethyl, phenyl and cyano.

23. The filament of claim 21 wherein the polyolefin is polystyrene.

24. The filament of claim 21 wherein the polyolefin is a copolymer of ethylene and propylene.

25. The filament of claim 21 wherein the polyolefin is a copolymer of styrene.

* * * * *